US009581943B2

(12) United States Patent
Aiba et al.

(10) Patent No.: US 9,581,943 B2
(45) Date of Patent: Feb. 28, 2017

(54) HEAT FIXING APPARATUS AND GREASE COMPOSITION FOR THE HEAT FIXING APPARATUS

(71) Applicants: CANON KABUSHIKI KAISHA, Tokyo (JP); DOW CORNING TORAY CO., LTD., Tokyo (JP)

(72) Inventors: Hirohiko Aiba, Suntou-gun (JP); Satoru Taniguchi, Mishima (JP); Masaki Hirose, Suntou-gun (JP); Teruyoshi Tanaka, Gotenba (JP)

(73) Assignees: CANON KABUSHIKI KAISHA, Tokyo (JP); DOW CORNING TORAY CO., LTD., Tokyo (JP)

( * ) Notice: Subject to any disclaimer, the term of this patent is extended or adjusted under 35 U.S.C. 154(b) by 0 days.

(21) Appl. No.: 14/693,007

(22) Filed: Apr. 22, 2015

(65) Prior Publication Data

US 2015/0316881 A1 Nov. 5, 2015

(30) Foreign Application Priority Data

Apr. 30, 2014 (JP) ..... 2014-094209

(51) Int. Cl.
*G03G 15/20* (2006.01)
*C10M 169/04* (2006.01)

(52) U.S. Cl.
CPC ..... *G03G 15/2025* (2013.01); *C10M 169/04* (2013.01); *G03G 15/2064* (2013.01)

(58) Field of Classification Search
CPC ..... G03G 15/2064; G03G 15/2025; C10M 169/04
USPC ..... 399/328
See application file for complete search history.

(56) References Cited

U.S. PATENT DOCUMENTS 3,658,709 A * 4/1972 Christian ..... C10M 7/00 508/258
5,149,941 A 9/1992 Hirabayashi et al.
5,300,997 A 4/1994 Hirabayashi et al.
5,343,280 A 8/1994 Hirabayashi et al.
5,525,775 A 6/1996 Setoriyama et al.
5,552,582 A 9/1996 Abe et al.
5,767,484 A 6/1998 Hirabayashi et al.
(Continued)

FOREIGN PATENT DOCUMENTS

JP 63-313182 A 12/1988
JP 4-044075 A 2/1992
(Continued)

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

Provided is a heat fixing apparatus, which suppresses the depletion of a lubricant applied to an inside of the heat fixing apparatus and which has long life and high reliability, the heat fixing apparatus including a heating rotary member and a pressurizing rotary member, and containing, as a lubricant in a sliding portion, (A) perfluoropolyether oil having a kinetic viscosity at 40° C. of from 100 to 200 $mm^2/s$ and an evaporation loss being 1.2 mass % or less in a case where 10 g of a sample of the perfluoropolyether oil is placed in a petri dish having an inner diameter of 41 mm and allowed to stand still at 250° C. for 200 hours and (B) polytetrafluoroethylene.

15 Claims, 2 Drawing Sheets

(56) References Cited

U.S. PATENT DOCUMENTS

| | | | | |
|---|---|---|---|---|
| 6,748,192 | B2 | 6/2004 | Izawa et al. | |
| 2004/0157970 | A1* | 8/2004 | Sarkar | C08K 5/06 524/366 |
| 2007/0287646 | A1* | 12/2007 | Kawamura | C10M 169/02 508/590 |
| 2013/0223903 | A1* | 8/2013 | Matsuura | G03G 15/2053 399/329 |
| 2015/0011446 | A1* | 1/2015 | Baskaran | C08G 65/007 508/549 |

FOREIGN PATENT DOCUMENTS

| | | | |
|---|---|---|---|
| JP | 8-016005 | A | 1/1996 |
| JP | 10-010893 | A | 1/1998 |
| JP | 2003-045615 | A | 2/2003 |

* cited by examiner

HEAT FIXING APPARATUS AND GREASE COMPOSITION FOR THE HEAT FIXING APPARATUS

BACKGROUND OF THE INVENTION

Field of the Invention

The present invention relates to a heat fixing apparatus and a grease composition for a heat fixing apparatus. Priority is claimed on Japanese Patent Application No. 2014-094209, filed on Apr. 30, 2014, the content of which is incorporated herein by reference.

Description of the Related Art

In image forming apparatus such as electrophotographic apparatus, so-called copying machines, and printers, hitherto, heat roller-type heat fixing apparatus have been widely used for applying heat and pressure to fix, onto a recording material such as a sheet, an unfixed toner image borne on the recording material.

From the standpoint of quick start and saving energy, film heating-type heat fixing apparatus and electromagnetic induction heating-type heat fixing apparatus, which cause films themselves to generate heat, have also been put to practical use in recent years.

Film heating-type heat fixing apparatuses are disclosed, for example, in Japanese Patent Application Laid-Open No. S63-313182 and Japanese Patent Application Laid-Open No. H04-044075.

The film heating-type heat fixing apparatus includes a heater as a heating member, a fixing film as a flexible rotary member that is brought into contact with the heater and rotates while applying heat, and a pressure roller as a pressurizing member that forms a fixing nip portion with the heater via the fixing film.

In the film heating-type heat fixing apparatus, a recording material bearing thereon an unfixed toner image is introduced between the fixing film and the pressure roller at the fixing nip portion and conveyed together with the fixing film while being sandwiched. Accordingly, the unfixed toner image is fixed onto the surface of the recording material by the pressure of the fixing nip portion with the application of heat from the heater via the fixing film. In this heat fixing apparatus, low heat capacity members are used for the heater and the fixing film, and it is sufficient if the heater, which is a heat source, is energized only at the time of executing image formation to generate heat of a predetermined fixing temperature. Accordingly, the heat fixing apparatus has advantages of a short waiting time from power-on of the image forming apparatus to entry into a state in which image formation can be executed and substantially small power consumption at the time of standby.

Japanese Patent Application Laid-Open No. 2003-045615 discloses a metal sleeve for heating, in which a cylindrical metal element tube is used as a base layer and a release layer is provided on the outer surface. In addition, Japanese Patent Application Laid-Open No. H10-010893 discloses a fixing belt, in which a heat resistant elastomer layer is formed on the outer surface of a metal or heat resistant plastic tube and further, a layer of silicone rubber or fluororesin is formed on the outer surface of the heat resistant elastomer layer.

The use of a metal, which has higher heat conductivity than a resin, in place of a hitherto used heat resistant resin, such as polyimide, for a base layer of the fixing film increases the heat conductivity of the fixing film itself, and accordingly, heat from the heater is more efficiently transferred to the recording material. Therefore, it is possible to accommodate the increase in speed of image forming apparatus by using the metal for the base layer of the fixing film. In addition, a fixing film in which the metal is used for the base layer has sufficient strength, thus resulting in an increase in durability and robustness.

Hitherto, fixing unevenness partially occurs in some cases because the surface of the fixing film cannot follow the shape of a toner layer, which is formed by multiply transferring images, when the toner image passes through the fixing nip portion. Fixing unevenness may appear as gloss unevenness of an image, or may lead to transparency unevenness in the case of OHTs (transparent sheets for overhead projectors) and the transparency unevenness may appear as an image defect when projected. To deal with this problem, an elastic layer is provided on the base layer of the fixing film so as to render the surface of the fixing film deformable along the toner layer. Therefore, when the elastic layer is provided as just described, heat is transferred from the fixing film to the toner layer arranged unevenly on an image in such a manner that the heat is enclosed by the fixing film, thereby achieving uniform fixing performance.

On the other hand, Japanese Patent Application Laid-Open No. H08-016005 discloses an electromagnetic induction heating-type heat fixing apparatus in which, with magnetic fluxes, eddy currents are induced in a film member and Joule heat of the eddy currents heats the fixing film itself. The heat fixing apparatus is able to directly heat the fixing film by using the occurrence of induced currents, and achieves a more highly efficient fixing process compared to a heat roller-type heat fixing apparatus having a halogen lamp as a heat source.

In electromagnetic induction heating-type heat fixing apparatus, a thin metal is often used for the base layer of the fixing film. Further, in the case where an electromagnetic induction heating-type heating fixing apparatus is used in a color image forming apparatus, a fixing film having an elastic layer provided on the base layer may be used.

In heat fixing apparatus using the fixing film described above, a lubricant is interposed between the fixing film and the heater or a sliding member, thereby reducing sliding friction between the fixing film and the heater or the sliding member and smoothing the rotational motion of the fixing film.

Both ends of the fixing film are regulated with fixing flanges so that a position in a longitudinal direction of the fixing film and a position in a direction intersecting a conveyance direction thereof are regulated. In some cases, a lubricant configured to reduce sliding friction is interposed also between sliding surfaces of the fixing flange and the fixing film.

Further, the lubricant is similarly interposed in a sliding portion located in the heat fixing apparatus, for example, between an axis of the pressure roller and a bearing that supports the axis, and thereby rotational motion is smoothened.

Because the heat fixing apparatus may be used under an elevated temperature of 180° C. or more, as the lubricant, a fluorine-based grease composition is adopted which shows excellent stability even under high-temperature environments. The basic constituents of the grease composition are base oil and a thickener and the grease composition is formed of perfluoropolyether oil (PFPE) as the base oil, a polytetrafluoroethylene (PTFE) homopolymer or copolymer as the thickener, and an added material, such as a small amount of a rust preventive, as an additive.

The perfluoropolyether oil is roughly classified into a straight-chain type and a side-chain type, and the straight-chain type has small temperature dependence of kinetic viscosity compared to the side-chain type. That is, the straight-chain type has viscosity under a low-temperature environment lower than that of the side-chain type and has viscosity under a high-temperature environment higher than that of the side-chain type. From the viewpoint of reducing driving torque required for activation from a state in which the lubricant is cold under a low-temperature environment, it is preferred that the lubricant to be used in the heat fixing apparatus have low viscosity under a low-temperature environment. This is because the lubricant having low viscosity under a low-temperature environment enables the fixing film to rotate easily. On the other hand, from the viewpoint of suppressing the outflow of the lubricant from the end of the fixing film and the depletion of the lubricant from the sliding friction portion caused by the outflow in the case where the lubricant is used at high temperature, for example, during continuous printing, it is preferred that the lubricant have high viscosity under a high-temperature environment.

In a related-art heat fixing apparatus, perfluoropolyether oil of the straight-chain type having a chemical structure represented by the following structural formula (1) is used as the lubricant.

$$CF_3O\left[\left(CF_2CF_2O\right)_n\left(CF_2O\right)_m\right]CF_3 \quad (1)$$

However, in recent years, there is an increasing demand for the increase in speed and downsizing of a laser beam printer. In order to perform heat fixing treatment in an image forming apparatus at a higher speed, heat energy and pressure force higher than ever are required. Further, there is also a high demand for longer life, and a period of time during which the lubricant to be used in the heat fixing apparatus is exposed to high temperature is becoming long.

Therefore, in the case where the conventional perfluoropolyether oil of the straight-chain type is used as the lubricant, when the rotational motion of the fixing film is continued for a long period of time, the base oil in the lubricant may be evaporated to be depleted. Due to the depletion of the base oil, the slidability between the fixing film and the heater or between the fixing film and the fixing flange is lost, with the result that malfunction such as the breakage of the heater or the breakage of the fixing film may be caused.

Similarly, when the lubricant applied between the pressure roller and the pressure roller bearing is depleted within the life of a product to cause the bearing to be scraped off, abnormality may occur in the rotation of the pressure roller to cause, for example, a conveyance failure of a recording material.

Further, a part of the base oil evaporated in the heat fixing apparatus is conveyed along a conveyance path together with the recording material and decreased in temperature to be liquefied in the conveyance path, and thus there is a risk in that the base oil may adhere to various places on the conveyance path. For example, when the base oil adheres to a recording material conveyance roller on a downstream side of the heat fixing apparatus, the adhering base oil decreases the friction coefficient of the roller to have an adverse effect on conveyance performance. Therefore, the adhesion of the base oil has become a serious problem in ensuring the reliability of the heat fixing apparatus and extending the life thereof.

When the amount of the lubricant is increased so as to prevent the depletion of the lubricant, the amount of components adhering to the inside of the conveyance path is also increased. Therefore, although the problem of the depletion of the lubricant is solved, another problem such as the degradation in conveyance performance may be caused.

The present invention is directed to providing a heat fixing apparatus that suppresses the depletion of a fixing lubricant at higher temperature and the adhesion thereof to a conveyance path and that has long life and high reliability with the same amount of the lubricant as that of the related art.

The present invention is also directed to providing an image forming apparatus and an electrophotographic apparatus that contribute to form a high-quality electrophotographic image.

The present invention is also directed to providing a grease composition that can be used in the heat fixing apparatus.

SUMMARY OF THE INVENTION

According to one embodiment of the present invention, there is provided a heat fixing apparatus, including:

a heating rotary member;

a pressurizing rotary member configured to be brought into pressure contact with the heating rotary member;

a heating-side sliding portion configured to slide due to rotation of the heating rotary member;

a pressurizing-side sliding portion configured to slide due to rotation of the pressurizing rotary member; and a grease composition supplied at, at least one of the heating-side sliding portion and the pressurizing-side sliding portion to mediate sliding thereat, the heat fixing apparatus being configured to fix toner onto the recording material by heating and pressurizing the toner on a recording material in a nip portion formed by the heating rotary member and the pressurizing rotary member, in which the grease composition includes the following components:

(A) perfluoropolyether oil having a kinetic viscosity at 40° C. within a range of from 100 to 200 $mm^2/s$ and an evaporation loss of 1.2 mass % or less in a case where 10 g of a sample of the perfluoropolyether oil is placed in a petri dish having an inner diameter of 41 mm and allowed to stand still at 250° C. for 200 hours; and (B) polytetrafluoroethylene.

Further, according to one embodiment of the present invention, there is provided an image forming apparatus including the above-mentioned heat fixing apparatus.

Further, according to one embodiment of the present invention, there is provided an electrophotographic apparatus including the above-mentioned heat fixing apparatus.

In addition, according to one embodiment of the present invention, there is provided a grease composition for a heat fixing apparatus, including the following components:

(A) perfluoropolyether oil having a kinetic viscosity at 40° C. within a range of from 100 to 200 $mm^2/s$ and an evaporation loss of 1.2 mass % or less in a case where 10 g of a sample of the perfluoropolyether oil is placed in a petri dish having an inner diameter of 41 mm and allowed to stand still at 250° C. for 200 hours; and (B) polytetrafluoroethylene.

Further features of the present invention will become apparent from the following description of exemplary embodiments with reference to the attached drawings.

DESCRIPTION OF THE EMBODIMENTS

Figure 1:
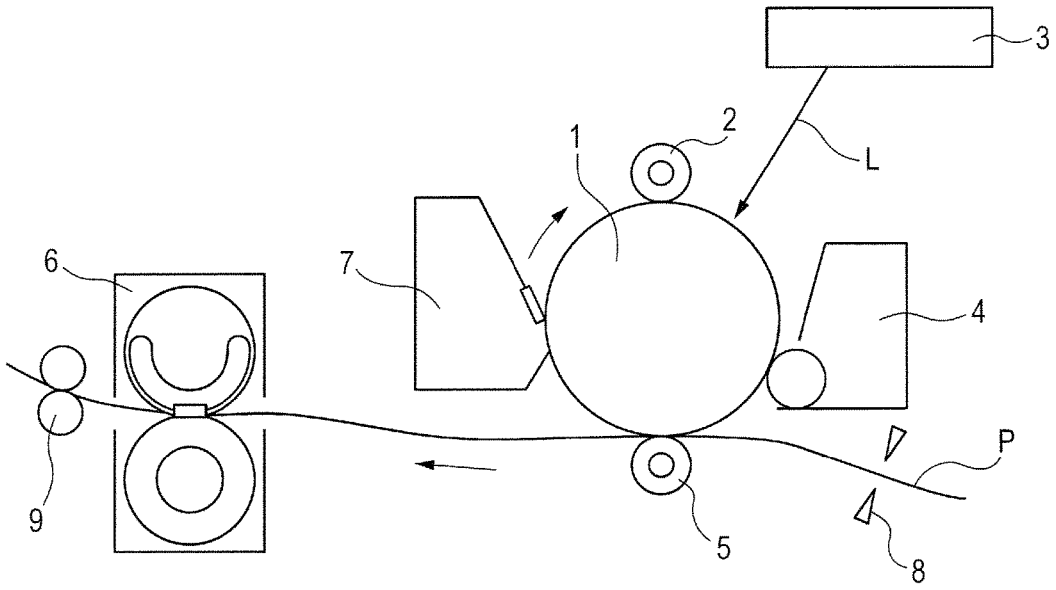
FIG. 1 is a schematic configuration view of an image forming apparatus.

A grease composition according to the present invention includes the following components (A) and (B):

(A) perfluoropolyether oil having a kinetic viscosity at 40° C. of from 100 to 200 $mm^2/s$ and an evaporation loss of 1.2 mass % or less in a case where 10 g of a sample of the perfluoropolyether oil is placed in a petri dish having an inner diameter of 41 mm and allowed to stand still at 250° C. for 200 hours; and (B) polytetrafluoroethylene.

The present invention does not exclude adding additives to be generally blended, such as a solid lubricant, a thickening agent, an antioxidant, an extreme pressure agent, an oily agent, a rust preventive, a corrosion inhibitor, a metal deactivator, a dye, a color phase stabilizer, a viscosity index improver, and a structure stabilizer, depending on the application as additives in addition to the above-mentioned components (A) and (B).

It is preferred that the component (A) serving as base oil contain a perfluoroethyleneoxy ($CF_2CF_2O$) unit and a perfluoromethyleneoxy ($CF_2O$) unit, and a ratio of the perfluoroethyleneoxy unit to the perfluoromethyleneoxy unit be less than 1. In particular, it is preferred that the component (A) contain perfluoropolyether oil (PFPE) represented by the following structural formula (1).

$$CF_3O\left[(CF_2CF_2O)_n(CF_2O)_m\right]CF_3 \quad (1)$$

It is preferred that, in the formula (1), n and m each represent a positive number, and a relationship of $n/m<1$ be satisfied. The relationship of $n/m<1$ means that the number of ($CF_2CF_2O$) units is smaller than the number of ($CF_2O$) units. When the relationship of $n/m<1$ is satisfied, the evaporation loss of the perfluoropolyether oil is decreased to enhance the technical effects of the invention of the present application. In this case, perfluoropolyether oil is generally synthesized as a mixture of two or more kinds of oils having different n/m ratios, and the numerical value of the n/m generally falls within a predetermined range. In particular, the n/m is preferably 0.80 or less, particularly preferably 0.70 or less, still more preferably 0.65 or less.

Further, the n/m falls within a range of preferably from 0.50 to 0.70, particularly preferably from 0.60 to 0.70.

Note that, n+m is preferably a number of from 40 to 180, which is a number within a range in which the kinetic viscosity at 40° C. satisfies the above-mentioned range. It is most preferred from the viewpoint of the technical effects of the present invention that the n+m be a number within a range in which the kinetic viscosity at 40° C. satisfies the above-mentioned range, and the n/m satisfies the above-mentioned preferred range.

The perfluoropolyether oil of the grease composition according to the present invention is preferred as base oil of a grease composition for a heat fixing apparatus to be exposed to high temperature because the perfluoropolyether oil is chemically inactive and hence is less liable to be decomposed even at high temperature.

The kinetic viscosity at 40° C. of the perfluoropolyether oil serving as the component (A) is from 100 to 200 $mm^2/s$, preferably from 110 to 170 $mm^2/s$. When the kinetic viscosity is less than 100 $mm^2/s$, there is a risk in that the lubricant may flow out from an end of a fixing film to be depleted when used at high temperature, for example, during continuous printing. Due to the depletion of the lubricant, the slidability between the fixing film and a heater or between the fixing film and a fixing flange is lost, with the result that malfunction such as the breakage of the heater or the breakage of the fixing film may be caused. When the kinetic viscosity is more than 200 $mm^2/s$, there is a risk in that the driving torque of the heat fixing apparatus required for activation from a state in which the lubricant is cold under a low-temperature environment may become excessively high.

In the perfluoropolyether oil serving as the component (A), an evaporation loss is 1.2 mass % or less in a case where 10 g of a sample of the perfluoropolyether oil is placed in a petri dish having an inner diameter of 41 mm and allowed to stand still at 250° C. for 200 hours. The evaporation loss is preferably 1.0% or less, most preferably 0.9% or less. When the evaporation loss is more than 1.2 mass %, there is a risk in that the base oil may be evaporated to be depleted in a device that is required to perform high-seed heat fixing treatment requiring high heat energy and pressure force. When the base oil is depleted, the slidability between the fixing film and the heater or between the fixing film and the fixing flange is lost, and thus there is a risk in that malfunction such as the breakage of the heater or the breakage of the fixing film may be caused. Further, a part of the base oil evaporated in the heat fixing apparatus is conveyed along a conveyance path together with the recording material and decreased in temperature to be liquefied in the conveyance path, and thus there is a risk in that the base oil may adhere to various places on the conveyance path.

In the perfluoropolyether oil serving as the component (A), it is preferred that a ratio of the perfluoroethyleneoxy unit to the perfluoromethyleneoxy unit be less than 1. In this case, even in the viscosity range (kinetic viscosity at 40° C. is from 100 to 200 $mm^2/s$), the relative content of the perfluoroethyleneoxy unit in molecules is small, and the evaporation loss is suppressed more effectively. As a result, the depletion of the applied lubricant is effectively suppressed, and even at high temperature, stable slidability can be ensured over a long period of time.

Polytetrafluoroethylene is preferred as a thickener of the grease composition for a heat fixing apparatus to be exposed to high temperature because polytetrafluoroethylene is chemically inactive and hence is less liable to be decomposed even at high temperature in the same way as in the perfluoropolyether oil.

Polytetrafluoroethylene is generally in the form of particles and has a primary particle diameter of 0.1 μm or more to 1.0 μm or less in terms of a value measured with an electron microscope in the present invention. Polytetrafluoroethylene can be appropriately selected to be used from those which are used as a thickener of a lubricant and the like.

Regarding the blending ratio of the component (B) to the component (A), the component (B) is blended within a range of preferably from 10 to 100 parts by mass, more preferably from 20 to 80 parts by mass with respect to 100 parts by mass of the component (A).

By setting the blending ratio of the component (B) to the component (A) within the above-mentioned range, it becomes easy to hold the grease composition in a semi-solid state, and the flowing away and falling of the grease composition and the depletion of the lubricant can be prevented more effectively.

The grease composition according to this embodiment can be manufactured by conventionally known various methods. Specifically, for example, the grease composition according to this embodiment can be manufactured by mixing perfluoropolyether oil with polytetrafluoroethylene. Alternatively, the grease composition according to this embodiment can be prepared by mixing perfluoropolyether oil with polytetrafluoroethylene and adding various additives as necessary to the mixture in advance, and subjecting the resultant to mill finish through a roll mill, followed by mixing, stirring, and defoaming.

Further, after the above-mentioned operation, as necessary, filtration, decompression, pressurization, overheating, cooling, inert gas displacement, and the like may be performed alone or in combination.

Of the various additives, boron nitride is preferred as a solid lubricant of the grease composition for a heat fixing apparatus to be exposed to high temperature because boron nitride is less liable to be decomposed even at high temperature in the same way as in the perfluoropolyether oil and polytetrafluoroethylene. It is preferred that boron nitride be in the form of particles and have an average particle diameter ($d_{50}$) of 0.1 μm or more to 1.0 μm or less. In particular, from the viewpoint of improving the lubricity of the grease composition for a heat fixing apparatus, boron nitride is preferably crystalline boron nitride, particularly preferably hexagonal boron nitride.

Note that, the average particle diameter of boron nitride can be measured by a laser diffraction and scattering method.

Regarding the blending ratio of boron nitride to the component (A), it is preferred that boron nitride be blended within a range of 25 parts by mass or less with respect to 100 parts by mass of the component (A). From the viewpoint of improving the lubricity of the grease composition for a heat fixing apparatus, it is preferred that boron nitride be blended preferably within a range of from 5 to 25 parts by mass.

Now, a heat fixing apparatus and an image forming apparatus according to the present invention are described in detail with reference to the drawings.

(1) Image Forming Apparatus

FIG. 1 is a schematic configuration view of an example of an image forming apparatus. The image forming apparatus is a laser beam printer using a transfer type electrophotographic process.

A photosensitive drum 1 serves an image bearing member and is rotationally driven at a predetermined peripheral velocity in a clockwise direction denoted by the arrow. A charging unit 2 such as a contact charging roller is provided so as to be brought into contact with the photosensitive drum 1, and a surface of the photosensitive drum 1 is uniformly charged to a predetermined polarity and potential by the charging unit 2.

A laser beam scanner 3 serving as an image exposure unit is provided on a downstream side of the charging unit 2 in a rotation direction of the photosensitive drum 1. The laser beam scanner 3 outputs scanning exposure light L that has been subjected to ON/OFF control in accordance with image information, and the charged surface of the photosensitive drum 1 is scanned by and exposed to the scanning exposure light L. Electric charge in an exposure bright section on the surface of the photosensitive drum 1 is removed by the scanning exposure, and thereby an electrostatic latent image corresponding to the image information is formed on the surface of the photosensitive drum 1.

The electrostatic latent image is developed and visualized as a toner image by a developing device 4. As a developing method, a jumping development method, a two-component development method, or the like is used, and image exposure and reversal development are used in combination in most cases.

The visualized toner image is transferred from the surface of the photosensitive drum 1 onto a recording material P serving as a material to be heated, which has been conveyed at predetermined timing by a transfer roller 5 serving as a transfer device.

In this case, timing is adjusted by detecting a leading end of the recording material P with a sensor 8 so that the formed position of the toner image on the photosensitive drum 1 is matched with a write position at the leading end of the recording material P. The recording material P conveyed at the predetermined timing is nipped and conveyed between the photosensitive drum 1 and the transfer roller 5. The recording material P having the toner image transferred thereon is conveyed to a heat fixing apparatus 6, and the toner image is heated and fixed onto the recording material P as a permanent image.

On the other hand, a transfer residual toner remaining on the photosensitive drum 1 is removed from the surface of the photosensitive drum 1 by a cleaning device 7 and is repeatedly used for forming an image.

(2) Heat Fixing Apparatus 6

Figure 2:
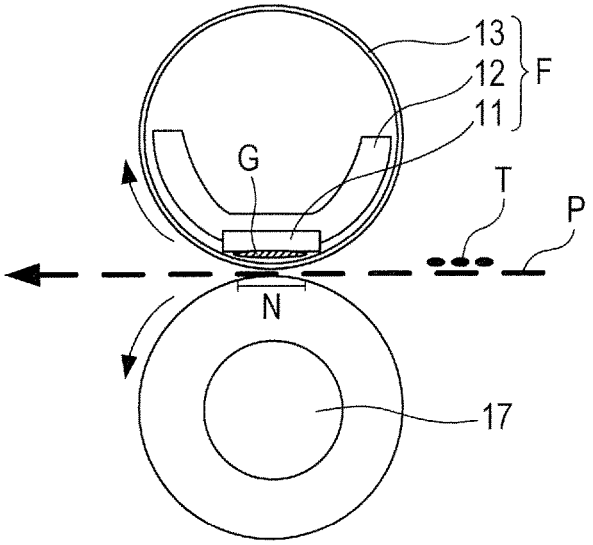
FIG. 2 is a sectional view of a heat fixing apparatus.
Figure 3:
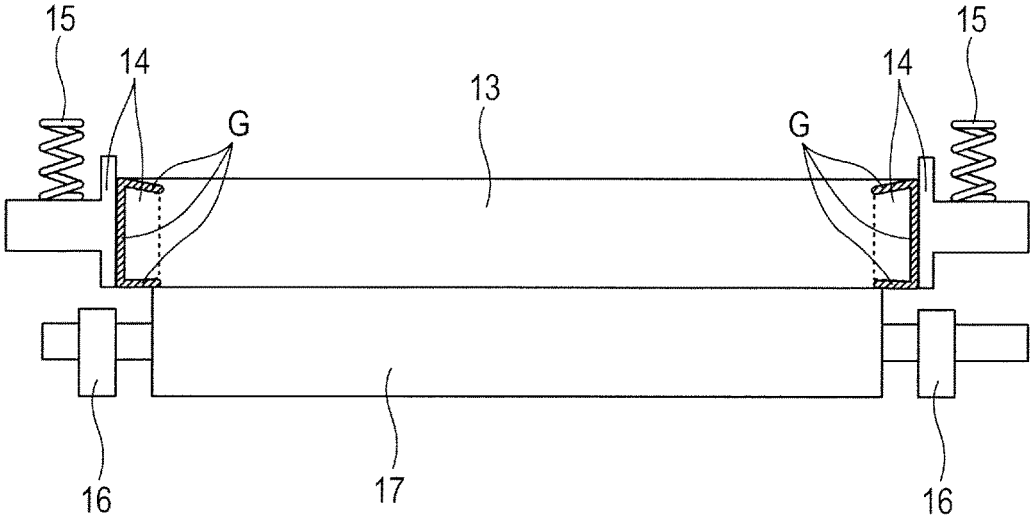
FIG. 3 is a schematic configuration view of the heat fixing apparatus.

FIGS. 2 and 3 are schematic configuration views of an example of the heat fixing apparatus 6. Note that, FIG. 2 is a schematic sectional view taken along a conveyance direction of the recording material P, and the broken line in FIG. 2 denotes the conveyance direction of the recording material P. FIG. 3 is a schematic side view in a center axis direction (longitudinal direction) of a sleeve orthogonal to the conveyance direction of the recording material P.

A fixing member F includes a fixing sleeve 13 serving as a cylindrical heating rotary member, a heater 11 serving as a heating member, a sleeve guide 12 serving as a holding member, end flanges 14 (hereinafter sometimes referred to as "fixing flanges") serving as a regulating member, and the like. The heater 11, the sleeve guide 12, and the end flanges 14 are arranged inside the fixing sleeve 13. Then, at least the heater 11 and the fixing sleeve 13 form the cylindrical heating rotary member.

The heater 11 is arranged on the lower surface of the sleeve guide 12 in a fixed manner. The fixing sleeve 13 is arranged in such a manner as to fit onto the sleeve guide 12. The fixing flanges 14 are mounted to both end portions of the sleeve guide 12 in a longitudinal direction of the sleeve guide 12, and serves to regulate both end portions of the fixing sleeve 13. Here, the longitudinal direction of the members, such as the heat fixing apparatus 6, the fixing member F, and the fixing sleeve 13, refers to a direction in which a rotational axis assumed at the time of rotation of the fixing sleeve 13 extends. The longitudinal direction is also a sheet width direction of the recording material P, orthogonal to the conveyance direction of the recording material P.

Note that, although there is exemplified the case in which the fixing sleeve 13 is heated by the heater 11 in the illustrated heat fixing apparatus 6, heat fixing apparatus adopting different heating methods, such as a heat fixing apparatus configured to heat the fixing sleeve by electromagnetic induction, can also be used.

At both the end portions in the longitudinal direction of the fixing member F, pressure springs 15 are provided on the fixing flanges 14. With the pressure springs 15, the fixing member F is pressed against the top surface of a pressure roller 17 under a predetermined pressurizing force, resisting the elasticity of an elastic layer, to be described later, of the fixing sleeve 13 and the elasticity of an elastic layer of the pressure roller 17, with the result that a fixing nip portion N having a predetermined width is formed. In the fixing nip portion N, due to the pressurization of the fixing member F with respect to the pressure roller 17, the fixing sleeve 13 is nipped between the heater 11 and the pressure roller 17 and deflected along a flat lower surface of the heater 11. Thus, an inner surface of the fixing sleeve 13 is brought into close contact with the flat lower surface of the heater 11.

Along with the rotational driving of the pressure roller 17, a rotational force is exerted on the fixing sleeve 13 due to a frictional force between the pressure roller 17 and the fixing sleeve 13 on the fixing member F side at the fixing nip portion N. Then, the fixing sleeve 13 is brought into close contact with the lower surface of the heater 11 arranged on the inner side of the fixing sleeve 13, and driven around the outer periphery of the sleeve guide 12 in a clockwise direction by the rotation of the pressure roller 17 with a sliding motion, with the result that the fixing sleeve 13 enters a rotational state (pressure roller driven type).

The pressure roller 17 serving as a pressurizing rotary member is supported by a pressure roller bearing 16 serving as a support member, and a portion in which a metal core of the pressure roller 17 and the pressure roller bearing 16 are brought into contact with and slide on each other serves as a pressurizing-side sliding portion. A small amount of a lubricant G configured to reduce the friction resistance at a time of rotational driving is interposed on a surface of the pressure roller bearing 16.

The fixing sleeve 13 rotates while an inner peripheral surface of the fixing sleeve 13 slides on the heater 11 and the sleeve guide 12 arranged in the fixing sleeve 13. Portions, in which the inner peripheral surface is brought into contact with and slides on the heater 11 and the sleeve guide 12, serve as heating-side sliding portions. In the sliding portions, it is necessary to suppress the friction resistance between the heater 11 and the fixing sleeve 13 and between the sleeve guide 12 and the fixing sleeve 13. Therefore, a small amount of the lubricant G having heat resistance is interposed in the sliding portions between the heater 11 and the fixing sleeve 13 and between the sleeve guide 12 and the fixing sleeve 13.

Similarly, a small amount of the lubricant G is interposed also in the sliding portion between the fixing sleeve 13 and the fixing flange 14 so as to suppress the friction resistance.

The pressure roller 17 is brought into pressure contact with the fixing sleeve 13, and the fixing sleeve 13 rotates due to the rotation of the pressure roller 17. When an electric current is applied to the heater 11, the temperature of the heater 11 is raised to predetermined temperature and adjusted. In this state, the recording material P bearing an unfixed toner image T is conveyed to the fixing nip portion N between the fixing sleeve 13 and the pressure roller 17 as denoted by the broken line in FIG. 2. Then, the recording material P is nipped and conveyed in the fixing nip portion N, and thus the unfixed toner image T is heated with heat from the heater 11 through the fixing sleeve 13 to be thermally fixed onto the recording material P.

The recording material P having passed through the fixing nip portion N is separated from an outer surface of the fixing sleeve 13 and guided by a heat-resistant fixing delivery guide to be delivered by fixing delivery rollers 9. In the fixing delivery rollers 9, a roller on a non-printing surface side serves as a driving roller and a roller on a printing surface side serves as a driven roller that is driven by the driving roller opposed to the driven roller. Further, the fixing delivery rollers 9 have such a structure that a member having high releasability is used as a surface layer so that contamination caused by vaporized components of toner wax and vaporized components of the lubricant generated from the heat fixing apparatus is less liable to occur.

(2a) Heater 11

The heater 11 serves as a heating member arranged on an inner side of the fixing sleeve 13 and performs heating of the fixing nip portion N so as to melt the unfixed toner image T on the recording material P and fix the unfixed toner image onto the recording material P. As the heater 11, there may be used a heater having such a structure that a substrate has formed successively thereon a heat generating member and a protective insulating layer configured to ensure the protection and insulation of the substrate and the heat generating member. As the substrate, there may be used, for example, an elongated ceramics substrate having a high insulation property made of aluminum oxide (alumina), aluminum nitride (AlN), or the like, and a heat-resistant resin substrate made of polyimide, PPS, a liquid crystal polymer, or the like. As the heat generating member, there may be used, for example, a heat generating member having a heat generating paste of Ag/Pd (silver palladium), $RuO_2$, $Ta_2N$, or the like printed thereon. As the protective insulating layer, there may be given a glass coat layer and the like.

Power is fed to the heat generating paste on the heater 11 from a power feeding part (not shown) via a connector (not shown). On the back of the heater 11, a temperature detecting element, such as a thermistor (not shown), is arranged for detecting the temperature of the heater 11 which rises according to the heat generation of the heat generating paste. According to a signal of the temperature detecting element, for example, the duty ratio and wave number of the voltage applied to the heat generating paste from an electrode portion (not shown) arranged at an end portion in the longitudinal direction of the heater 11 are controlled appropriately, with the result that the regulated temperature inside the fixing nip portion N is maintained substantially constant. Therefore, via the fixing sleeve 13, the heater 11 provides necessary heating for fixing the unfixed toner image T on the recording material P. DC energization of a temperature control part (not shown) by the temperature detecting element is obtained by a connector (not shown) via a DC energizing part and DC electrode portion (not shown).

On a surface of the heater 11 on the fixing nip portion N side, a protective layer such as a thin glass coat, a fluororesin layer, or a polyimide layer capable of withstanding the friction with the inner peripheral surface (surface) of the fixing sleeve 13 is formed. In this embodiment, a polyimide layer is used as the protective layer.

(2b) Sleeve Guide 12

The sleeve guide 12 serves as, for example, a support for the heater 11, a pressurizing member, and a heat insulating member for preventing heat dissipation in the opposite direction from the fixing nip portion N. The sleeve guide is a rigid, heat resistant insulating member, and is formed of, for example, a liquid crystal polymer, a phenolic resin, PPS, or PEEK. In this embodiment, a liquid crystal polymer is used.

(2c) Pressure Roller 17

The pressure roller 17 is a pressurizing member arranged to be opposed to the heater 11 with the fixing sleeve 13 interposed therebetween. The pressure roller 17 to be used may include a metal core made of a metal, such as stainless steel, SUM, or Al, and an elastic layer formed of heat resistant rubber such as silicone rubber or fluoro-rubber or formed by foaming silicone rubber, and arranged outside the metal core. In addition, in order to improve releasability and abrasion resistance, a release layer made of, for example, PFA, PTFE, or FEP may be formed to cover the elastic layer. The pressurizing rotary member may adopt the form of a rotary belt or the like instead of the pressure roller 17.

(2d) Fixing Sleeve 13

As the fixing sleeve 13, a cylindrical heating rotary member can be used, which includes a cylindrical base layer, an elastic layer having elasticity formed on an outer circumference of the base layer so as to cover the base layer, and a release layer having releasability arranged so as to cover the elastic layer.

As the base layer, an endless belt having a small heat capacity and flexibility can be used. In order to enable quick start, it is preferred that the base layer have a thickness of 200 μm or less. It is preferred that the base layer be made of a single metal, such as stainless steel, Al, Ni, Cu, or Zn, or an alloy thereof having heat resistance and high thermal conductivity, and have flexibility. On the other hand, a base layer having a thickness of 15 μm or more is preferred as a base layer having sufficient strength and excellent durability in order to form a heat fixing apparatus with a long life. On the inner surface of the base layer, which is in contact with the heater 11, for example, a fluororesin layer, polyimide layer, or polyamide-imide layer having high lubricity may be formed.

With a view to achieving a sufficient toner fixing property and preventing fixing unevenness for supporting high quality imaging and the increase in speed, it is preferred that the elastic layer include a heat resistant elastic member formed of silicone rubber or the like to transfer heat to the unfixed toner image T on the recording material P in such a manner that the heat is enclosed by the elastic layer. In order to support high quality imaging and the increase in speed with the use of the heat enclosure effect, it is preferred that the elastic layer have a thickness of 30 μm or more. On the other hand, in order to enable quick start, it is preferred that the thickness be 500 μm or less. In addition, the elastic layer may contain an additive, such as a heat-conductive filler, in order to improve the heat conductivity.

In order to improve releasability and abrasion resistance, the release layer may be arranged on the elastic layer by, for example, tube molding or coating of a fluororesin, such as PFA, PTFE, or FEP. For abrasion resistance against the recording material P due to sheet feeding, it is preferred that the release layer have a thickness of 5 μm or more. On the other hand, it is preferred that the thickness be 100 μm or less in order to enable quick start.

(2e) Supply Position of Lubricant G

In the heat fixing apparatus according to the present invention, the grease composition containing the component (A) and the component (B) described above is supplied as the lubricant so as to mediate sliding in at least one of the sliding portion in the heating rotary member and the sliding portion in the pressurizing rotary member.

In the illustrated apparatus configuration, in order to control the frictional resistance between the fixing sleeve 13 and the heater 11 and between the fixing sleeve 13 and the guide 12 to be small and maintain stable slidability throughout the life of the heat fixing apparatus 6, the lubricant G is applied between the fixing sleeve 13 and the sliding portions of the heater 11 and the guide 12. Because the heater 11 may be used at a temperature of 180° C. or more, as the lubricant G, the fluorine-based grease composition is used which shows excellent stability under severe conditions such as high-temperature environments. The lubricant G is formed of the perfluoropolyether oil as the base oil and polytetrafluoroethylene as the thickener, and an additive such as a rust preventive may be added thereto.

Further, the lubricant G is similarly applied between the fixing sleeve 13 and the fixing flange 14 so as to suppress the friction resistance. Specifically, the lubricant G is applied to the sliding portion between an inner surface of the fixing sleeve 13 and the fixing flange 14, and the sliding portion between the end of the fixing sleeve 13 in the longitudinal direction and the fixing flange 14.

Further, the lubricant is applied to the sliding portion between the pressure roller bearing 16 and the metal core of the pressure roller 17.

The grease composition containing the component (A) and the component (B) described above is supplied to at least one of the sliding portions.

According to the present invention, a heat fixing apparatus can be obtained, which suppresses the depletion of the lubricant and the adhesion thereof to the conveyance path and which has stable fixing performance and conveyance performance until the end of the life of the heat fixing apparatus.

Now, the lubricant according to the present invention is further described by way of Examples and Comparative Example.

EXAMPLE 1

(1) Preparation of Grease Composition as Lubricant

In order to verify the effects of the present invention, polytetrafluoroethylene and boron nitride were added to be mixed in blending ratios shown in Table 1 below with respect to 100 parts by mass of perfluoropolyether oil. Each mixture was subjected to mill finish through a roll mill, followed by mixing, stirring, and defoaming, to prepare a grease composition according to Example 1. The worked penetration on a ½ scale of the obtained grease composition measured by a method specified under JIS K 2220 was 280±10. Further, the kinetic viscosity of the base oil at 40° C. and the evaporation loss of the base oil at 250° C. of the obtained grease composition were measured. Table 1 shows the results.

TABLE 1

| | Comparative Example | Example (a) | Example (b) |
|---|---|---|---|
| Base oil | PFPE(a) | PFPE(b) | PFPE(b) |
| Thickener/blending amount (parts by mass) | PTFE/55 | PTFE/55 | PTFE/15 |
| Additive/blending amount (parts by mass) | — | — | BN/20 |
| Kinetic viscosity of base oil at 40° C. ($mm^2/s$) | 151 | 154 | 154 |
| Evaporation loss of base oil at 250° C. for 200 hours (%) | 1.60 | 0.88 | 0.88 |

PEPE(a): Perfluoropolyether oil represented by the structural formula (1) (the kinetic viscosity at 40° C. measured by the method specified under JIS K 2283 is 151 $mm^2/s$, and further the evaporation loss in the case where 10 g of a sample of the perfluoropolyether oil is placed in a petri dish having an inner diameter of 41 mm and allowed to stand still at 250° C. for 200 hours is 1.60%; note that, PFPE(a) is represented by the structural formula (1), and n/m is a number within a range of >1)

PFPE(b): Perfluoropolyether oil represented by the structural formula (1) (the kinetic viscosity at 40° C. measured by the method specified under JIS K 2283 is 154 $mm^2/s$, and the evaporation loss in the case where 10 g of a sample of the perfluoropolyether oil is placed in a petri dish having an inner diameter of 41 mm and allowed to stand still at 250° C. for 200 hours is 0.88%; note that, PFPE(b) is represented by the structural formula (1), and n/m is a number within a range of from 0.6 to 0.7)

PTFE: Polytetrafluoroethylene (primary particle diameter: about 0.3 μm; trade name: Lubron L2 (manufactured by Daikin Industries, Ltd.)

BN: Boron nitride (average particle diameter ($d_{s0}$)=0.5 μm; trade name: SHOBN UHP-S1 (manufactured by Showa Denko K.K.))

(2) Comparison Results of Durability in Heat Fixing Apparatus

In order to verify the effects of the grease composition serving as the lubricant in Example 1, an acceleration test was conducted for the durability of the heat fixing apparatus 6 by the following method. In this test, as an image forming apparatus, a monochromatic laser beam printer having a recording material conveyance speed of 350 mm/sec, configured as illustrated in FIGS. 1 and 2, was used. Note that, in Example 1, AlN having satisfactory heat conductivity was used as a substrate for the heater 11, and hence a heat generating paste layer and a glass coat layer were formed on the substrate on an opposite side of the fixing nip portion N. A polyimide layer was formed as a protective layer on a surface of the heater 11 on the fixing nip portion N side. As the sleeve guide 12, a liquid crystal polymer was used.

As the pressure roller 17, a pressure roller was used, which included a metal core made of Al, an elastic layer made of silicone rubber mixed with a conductive filler, and a release layer made of PFA. The outer diameter of the pressure roller was set to ϕ30 mm, and in order to stabilize the conveyability of a recording material, an inverted crown shape of 100 μm was formed on the elastic layer of the pressure roller.

As the fixing sleeve 13, a fixing sleeve having an outer diameter of 30 mm was used, which included a base layer made of stainless steel having a thickness of 35 μm, an elastic layer made of highly heat-conductive silicone rubber having a thickness of 270 μm, and a release layer made of PFA having a thickness of 14 μm.

As the pressure roller bearing 16, a bearing made of polyphenylene sulfide (PPS) was used. In Example 1, 500 mg of the lubricant was applied to the sliding portion between the heater 11 and the fixing sleeve 13. Further, 65 mg of the lubricant was applied to the sliding portion between the fixing flange 14 and the fixing sleeve 13 at each end in the longitudinal direction.

The acceleration test was conducted under the following conditions.

The heat fixing apparatus 6 was idled at a temperature adjusted to 240° C. in a state in which the recording material P was not caused to pass through the heat fixing apparatus 6.

The idling time taken for the occurrence of the breakage of the heater or the fixing sleeve was measured. The idling time taken for the occurrence of the breakage was defined as the time taken for the depletion of the lubricant, and Table 2 shows the results.

TABLE 2

| | |
|---|---|
| Comparative Example | 293 hours |
| Example (a) | 480 hours |
| Example (b) | 528 hours |

As shown in Table 2, in the lubricant of Comparative Example, it took about 293 hours for the heat fixing apparatus 6 to be broken. On the other hand, in the case of using the lubricant of Example (a), it took about 480 hours for the breakage to occur, and thus the life was able to be extended by 1.6 times. Further, in the lubricant of Example (b) using BN as the additive for improving lubricity, it took about 528 hours for the breakage to occur, and thus the life was able to be further extended.

(3) Comparison Results of Conveyability in Fixing Delivery Roller 9

Next, the conveyability in the fixing delivery roller 9, which was considered as another problem of Comparative Example, was compared and studied through use of the above-mentioned lubricants. In the comparison and study, the monochromatic laser beam printer used for the above-mentioned comparison of durability in the heat fixing apparatus was used.

Regarding the conveyability of the fixing delivery roller 9, a durability test was conducted in the image forming apparatus using the lubricants according to Comparative Example and Example 1, and the numbers of passing paper sheets counted until a conveyance failure of a recording material occurred in the fixing delivery roller in Comparative Example and Example 1 were compared to each other.

Table 3 shows the results.

TABLE 3

| | |
|---|---|
| Comparative Example | Conveyance failure occurs at 325k passing paper sheets |
| Example (a) | No conveyance failure occurs even after 400k passing paper sheets |
| Example (b) | |

As shown in Table 3, in the lubricant according to Comparative Example, the contamination of the fixing delivery roller 9 and the conveyance failure of the recording material caused by the contamination occurred at about 325 k passing paper sheets. On the other hand, in the case of using the lubricants according to Example 1, the contamination of the fixing delivery roller 9 and the conveyance failure of the recording material did not occur even after 400 k passing paper sheets.

As described above, according to the present invention, by using the grease composition for a heat fixing apparatus containing perfluoropolyether oil having a kinetic viscosity at 40° C. of from 100 to 200 $mm^2/s$ and an evaporation loss of 1.2 mass % or less in a case where 10 g of a sample of the perfluoropolyether oil is placed in a petri dish having an inner diameter of 41 mm and allowed to stand still at 250° C. for 200 hours, and polytetrafluoroethylene, a heat fixing apparatus can be provided, which can suppress the depletion of the lubricant and the adhesion thereof to the conveyance roller on a downstream side of the heat fixing apparatus and which has stable conveyance performance and fixing performance for a long period of time. More preferably, by using boron nitride having an average particle diameter of 1 μm or less as an additive, the life of the heat fixing apparatus can be further extended.

Note that, in Example 1, although there is exemplified the case in which the fixing sleeve 13 is heated by the heater 11, the same effects can obtained also from heat fixing apparatus adopting different heating methods, such as a heat fixing apparatus configured to heat the fixing sleeve by electromagnetic induction, by using the lubricants according to Example 1 in the sliding portions.

EXAMPLE 2

The effects of the lubricant in the sliding portion between the pressure roller bearing 16 and the metal core of the pressure roller 17 were compared and studied.

Also in the comparison and study, the monochromatic laser beam printer used for the above-mentioned comparison of durability in the heat fixing apparatus was used.

A small amount of the lubricant G was interposed on a surface of the pressure roller bearing 16 so as to reduce the friction resistance at a time of rotation of the pressure roller 17.

However, in Comparative Example, as the heat fixing apparatus 6 is approaching the end of life, the lubricant applied to the pressure roller bearing 16 may be depleted. As a result, the pressure roller bearing 16 abrades away, and the friction resistance at a time of rotation of the pressure roller 17 increases, to thereby cause a problem such as a conveyance failure of a recording material.

In order to confirm the effects of the grease composition according to the present invention, an acceleration test was conducted for the abrasion amount of the pressure roller bearing 16 by the following method.

24 mg of the lubricant is applied to the sliding portion on the pressure roller bearing 16 with respect to the pressure roller 17. The heat fixing apparatus 6 is idled at a temperature adjusted to 240° C. in a state in which the recording material P is not caused to pass through the heat fixing apparatus 6, and the abrasion amount of the pressure roller bearing 16 after the elapse of 200 hours is measured.

Table 4 shows the results.

TABLE 4

| | Abrasion amount of pressure roller bearing 16 |
|---|---|
| Comparative Example | 0.7 mm |
| Example | 0.4 mm |

As shown in Table 4, in the lubricant according to Comparative Example, the abrasion of 0.7 mm occurred due to the idling for 200 hours. On the other hand, in the case of using the lubricant according to Example, the abrasion of 0.4 mm occurred, and thus the abrasion was able to be reduced.

As described above, according to the present invention, by using, in the bearing sliding portion, the grease composition for a heat fixing apparatus containing perfluoropolyether oil having a kinetic viscosity at 40° C. of from 100 to 200 $mm^2/s$ and an evaporation loss of 1.2 mass % or less in a case where 10 g of a sample of the perfluoropolyether oil is placed in a petri dish having an inner diameter of 41 mm and allowed to stand still at 250° C. for 200 hours, and polytetrafluoroethylene, a heat fixing apparatus can be provided, which can suppress the depletion of the lubricant and has stable conveyance performance for a long period of time.

Note that, in Example 2, although there is exemplified the case in which the lubricant is applied to the sliding portion between the pressure roller bearing 16 and the pressure roller 17, the stable slidability can also be ensured for a long period of time by applying the lubricant according to Example to a portion, which reaches high temperature, in any sliding portion within the heat fixing apparatus, instead of the sliding portion between the pressure roller bearing 16 and the pressure roller 17.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-094209, filed Apr. 30, 2014, which is hereby incorporated by reference herein in its entirety.

What is claimed is:

1. A heat fixing apparatus comprising:

a heating rotary member;

a pressurizing rotary member configured to be brought into pressure contact with the heating rotary member;

a heating-side sliding portion configured to slide due to rotation of the heating rotary member;

a pressurizing-side sliding portion configured to slide due to rotation of the pressurizing rotary member; and a grease composition supplied at, at least one of the heating-side sliding portion and the pressurizing-side sliding portion to mediate sliding thereat, the heat fixing apparatus being configured to fix toner onto the recording material by heating and pressurizing the toner on a recording material in a nip portion formed by the heating rotary member and the pressurizing rotary member, wherein the grease composition comprises:

a base oil; and polytetrafluoroethylene particles, and wherein the base oil is a perfluoropolyether oil having a kinetic viscosity at 40° C. from 100 to 200 $mm^2/s$ and an evaporation loss of 1.2 mass % or less in a case where 10 g of a sample of the perfluoropolyether oil is placed in a petri dish having an inner diameter of 41 mm and allowed to stand still at 250° C. for 200 hours.

2. The heat fixing apparatus according to claim 1, wherein the perfluoropolyether oil comprises a perfluoroethyleneoxy unit and a perfluoromethyleneoxy unit, and a ratio of the perfluoroethyleneoxy unit to the perfluoromethyleneoxy unit is less than 1.

3. The heat fixing apparatus according to claim 1, wherein the perfluoropolyether oil comprises a perfluoropolyether oil represented by structural formula (1):

$$CF_3O-[(CF_2CF_2O)_n(CF_2O)_m]-CF_3, \quad (1)$$

wherein, in the structural formula (1), n and m each represent a positive number, n/m is a number of less than 1, and n+m is a number such that the kinetic viscosity at 40° C. is from 100 to 200 $mm^2/s$.

4. The heat fixing apparatus according to claim 1, wherein the grease composition comprises 100 parts by mass of the base oil and 10 to 100 parts by mass of the polytetrafluoroethylene particles.

5. The heat fixing apparatus according to claim 1, wherein the grease composition further comprises boron nitride having an average particle diameter of 1 μm or less.

6. The heat fixing apparatus according to claim 1, wherein the heating rotary member comprises a cylindrical heating rotary member, and wherein the heating-side sliding portion serves as a sliding portion between an inner peripheral surface of the cylindrical heating rotary member and a holding member arranged in the cylindrical heating rotary member so as to hold the cylindrical heating rotary member.

7. The heat fixing apparatus according to claim 6, wherein the cylindrical heating rotary member comprises a regulating member arranged in the cylindrical heating rotary member, and wherein the heating-side sliding portion serves as a sliding portion between the inner peripheral surface of the cylindrical heating rotary member and the regulating member.

8. The heat fixing apparatus according to claim 1, wherein the pressurizing-side sliding portion serves as a sliding portion between the pressurizing rotary member and a support member configured to support the pressurizing rotary member.

9. An image forming apparatus, comprising the heat fixing apparatus according to claim 1.

10. An electrophotographic apparatus, comprising the heat fixing apparatus according to claim 1.

11. A grease composition for a heat fixing apparatus, comprising:

a base oil; and polytetrafluoroethylene particles, wherein the base oil is a perfluoropolyether oil having a kinetic viscosity at 40° C. from 100 to 200 $mm^2/s$ and an evaporation loss of 1.2 mass % or less in a case where 10 g of a sample of the perfluoropolyether oil is placed in a petri dish having an inner diameter of 41 mm and allowed to stand still at 250° C. for 200 hours.

12. The grease composition according to claim 11, wherein the perfluoropolyether oil comprises a perfluoroethyleneoxy unit and a perfluoromethyleneoxy unit, and a ratio of the perfluoroethyleneoxy unit to the perfluoromethyleneoxy unit is less than 1.

13. The grease composition according to claim 11, wherein the perfluoropolyether oil comprises a perfluoropolyether oil represented by structural formula (1):

$$CF_3O-[(CF_2CF_2O)_n(CF_2O)_m]-CF_3, \quad (1)$$

wherein, in the structural formula (1), n and m each represent a positive number, n/m is a number of less than 1, and n+m is a number such that the kinetic viscosity at 40° C. is from 100 to 200 $mm^2/s$.

14. The grease composition according to claim 11, which comprises 100 parts by mass of the base oil and 10 to 100 parts by mass of the polytetrafluoroethylene particles.

15. The grease composition according to claim 11, further comprising boron nitride having an average particle diameter of 1 μm or less.

* * * * *